US011225312B2

(12) United States Patent
Wheelock

(10) Patent No.: US 11,225,312 B2
(45) Date of Patent: Jan. 18, 2022

(54) SUPPORT FOR AN OUTBOARD MOTOR

(71) Applicant: Paul A. Wheelock, Peosta, IA (US)

(72) Inventor: Paul Wheelock, Peosta, IA (US)

( * ) Notice: Subject to any disclaimer, the term of this patent is extended or adjusted under 35 U.S.C. 154(b) by 47 days.

(21) Appl. No.: 16/795,037

(22) Filed: Feb. 19, 2020

(65) Prior Publication Data

US 2020/0262534 A1 Aug. 20, 2020

Related U.S. Application Data

(60) Provisional application No. 62/807,578, filed on Feb. 19, 2019.

(51) Int. Cl.
*B63H 20/00* (2006.01)
*B63H 20/06* (2006.01)

(52) U.S. Cl.
CPC ..... *B63H 20/06* (2013.01)

(58) Field of Classification Search
None
See application file for complete search history.

(56) References Cited

U.S. PATENT DOCUMENTS 4,846,740 A * 7/1989 Forsgren ..... B63H 20/10 440/53
5,775,669 A * 7/1998 Huggins ..... B63H 20/36 248/351
5,782,662 A * 7/1998 Icenogle ..... B63H 20/106 248/641
6,309,267 B1 * 10/2001 Okabe ..... F02B 61/045 123/195 P
7,399,211 B1 * 7/2008 Spaulding ..... B63H 20/007 248/640
8,827,233 B2 * 9/2014 Crane ..... F24F 13/20 248/674
2009/0258551 A1 * 10/2009 Nomura ..... B63H 20/02 440/76

* cited by examiner

*Primary Examiner* — Steven M Marsh
(74) *Attorney, Agent, or Firm* — Dentons Davis Brown, P.C.; Kassandra Ricklefs

(57) ABSTRACT

Disclosed herein are various devices for the support of an outboard motor. The device having a body with a plurality of notches shaped to couple various pieces of the boat, outboard motor, and/or mounting bracket.

17 Claims, 9 Drawing Sheets

SUPPORT FOR AN OUTBOARD MOTOR

CROSS-REFERENCE TO RELATED APPLICATION(S)

This application claims the benefit under 35 U.S.C. § 119(e) to U.S. Provisional Application 62/807,578, filed Feb. 19, 2019, and entitled "Outboard Motor Support", which is incorporated herein by reference in its entirety for all purposes.

TECHNICAL FIELD

The disclosure relates to motorized boats, including devices for use with motorized boats, especially devices for supporting an outboard motor during ground transport and storage.

BACKGROUND

Outboard motors on motorized boats are often supported by known hydraulic systems when such a boat is out of the water. These hydraulic systems hold the outboard motor away from the rear/transom of the boat.

There is a need in the art for devices, systems, and methods to support outboard motors safely, conveniently, and effectively.

BRIEF SUMMARY

Discussed herein are various devices, systems and methods for supporting an outboard motor on a boat.

In Example 1, an outboard motor cushion having a substantially rectangular body comprises a first contact surface, a second contact surface, a plurality of first notches in the first contact surface, and a plurality of second notches in the second contact surface wherein the plurality of first notches are sized and shaped to fit an outboard motor, and wherein the plurality of second notches are sized and shaped to fit a mounting bracket.

Example 2 relates to the cushion of Example 1, wherein the cushion is comprised of EPDM rubber.

Example 3 relates to the cushion of Example 1, further comprising a tether operatively engaged with the body.

Example 4 relates to the cushion of Example 3, further comprising a clip attached to the tether wherein the clip is constructed and arranged to be releasably engaged with a boat.

Example 5 relates to the cushion of Example 4, further comprising an opening defined within the body, wherein the tether is threaded through the opening.

Example 6 relates to the cushion of Example 1, further comprising at least one third notch sized and shaped to fit a midsection of an outboard motor.

Example 7 relates to the cushion of Example 1, wherein the plurality of first notches are semicircular.

In Example 8, a device for supporting an outboard motor comprises a body comprising a first contact surface and a second contact surface. The device further comprises a first notch and a second notch defined within the first contract surface and a third notch defined within the second contact surface, wherein the first contact surface is configured to interface with an outboard motor, and wherein the second contact surface is configured to interface with an outboard motor mounting bracket.

Example 9 relates to the device of Example 8, wherein the device is comprised of EPDM rubber.

Example 10 relates to the device of Example 8, further comprising a fourth notch defined within the first contact surface and a fifth notch defined within the second contact surface.

Example 11 relates to the device of Example 8, wherein the body is substantially rectangular.

Example 12 relates to the device of Example 8, further comprising a tether operatively engaged with the body.

Example 13 relates to the device of Example 12, wherein the tether is threaded through an opening within the body.

Example 14 relates to the device of Example 13, further comprising a clip fixedly attached to the tether, wherein the clip is configured to be releasably attached to a boat.

In Example 15, an outboard motor cushion having a substantially rectangular body comprises a first contact surface comprising a first notch, a second notch, and a third notch. The cushion further comprises a second contact surface comprising a fourth notch and a fifth notch wherein the first notch, second notch, and third notch are sized and shaped to operatively couple various portions of an outboard motor, and wherein the fourth notch and fifth notch are sized and shaped to operatively couple various portions of a mounting bracket or transom.

Example 16 relates to the outboard motor cushion of Example 15, further comprising a tether operatively engaged with the substantially rectangular body.

Example 17 relates to the outboard motor cushion of Example 16, wherein the tether further comprises a clip.

Example 18 relates to the outboard motor cushion of Example 15, wherein the first notch and second notch are semicircular and about 1 inch in diameter.

Example 19 relates to the outboard motor cushion of Example 18, wherein the third notch is semicircular and about 3.5 inches in diameter.

Example 20 relates to the outboard motor cushion of Example 19, wherein the fourth notch and fifth notch are about 1 inch in depth and 1.75 inches wide.

While multiple embodiments are disclosed, still other embodiments of the disclosure will become apparent to those skilled in the art from the following detailed description, which shows and describes illustrative embodiments of the invention. As will be realized, the disclosure is capable of modifications in various obvious aspects, all without departing from the spirit and scope of the disclosure. Accordingly, the drawings and detailed description are to be regarded as illustrative in nature and not restrictive.

DETAILED DESCRIPTION

Figure 1A:
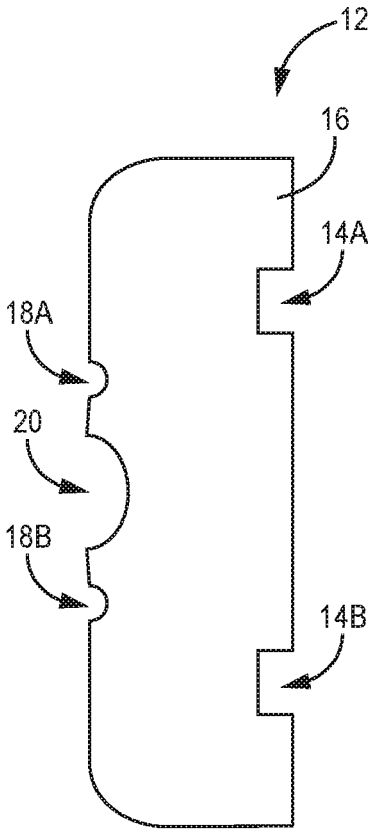
FIG. 1A is a top view of the device, according to one embodiment.

The various embodiments disclosed herein relate to a device and/or article of manufacture for supporting and cushioning an outboard motor during ground transportation and/or storage of the boat to which the motor is attached.

It is appreciated that transom supports that connect a boat to a trailer produce shock and vibration when the trailer moves at different rate than the boat due to weight and trailer bunk/roller properties. Known motor locks, stow supports, and wedge transom savers—all of which are known devices for outboard motor support—require a user to reach between the motor pivot and transom of the boat for placement and removal of these known devices. Further, removal of these known devices requires bending over, out of sight of a driver of a towing vehicle, increasing the chance of a driver backing over the individual placing/removing a prior device. Additionally, many of these prior devices, if still in place after the boat is launched, require reaching over the back of the boat to remove the device, or more often having to remove the boat from the water to remove the device and then relaunching the boat. Still further, these known systems and devices place the pressure or weight on one part of the boat, creating a pressure point that could damage the boat or motor.

Taking the pressure/stress off the transom of the boat, the hydraulics, and other systems during ground transportation and storage is important to the safe keeping and long life of the boat and motor.

The various embodiments disclosed or contemplated herein address the above issues. In some implementations, the device disclosed or contemplated herein can be placed from either side of the boat between the outboard motor and/or transom of the boat. The device allows for reduced vibration and shock during ground transportation of the boat. In various implementations, the device can take stress off of the hydraulic system of the motor during storage. Further, the shape of the device may be adjusted to fit a particular boat, mounting bracket and/or motor make and model.

The various embodiments of the device or article increase safety in the operation of the boat, in that the device can be removed and placed between the motor and the transom while the user is in a standing or upright position, rather than bent over. Remaining in an upright position increases visibility of the user from the perspective of the operator of a towing vehicle, such as a truck, thereby increasing the safety of the user. As noted above, prior attempts to solve the problems described herein have required a user to bend down out of sight and place a hand near the pivot point of the motor. These actions can be dangerous, risking injury to the hand near the pivot point and/or being backed over by a towing vehicle operator.

In various implementations, the device or article is structured and shaped such that weight from the motor is distributed evenly over the entire contact surface of the device that is in contact with the transom and/or mounting bracket. This distribution of the force resulting from the weight of the motor minimizes the risk of damage to the structure(s) in contact with the contact surfaces of the device.

The device, according to some embodiments, may be made from EPDM rubber, or any other known suitable material that is semi-pliable, or combination of such materials, as would be known to those of skill in the art.

Figure 1B:
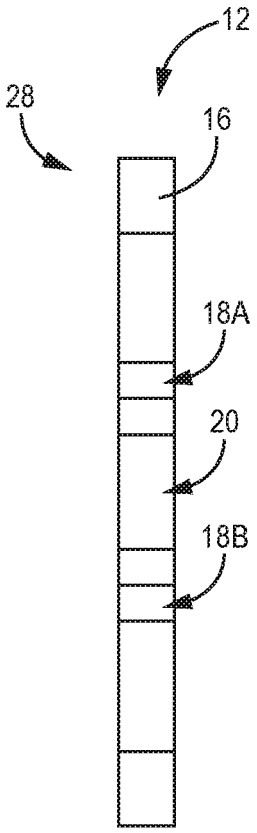
FIG. 1B is a side view of the device, according to one embodiment.
Figure 1C:
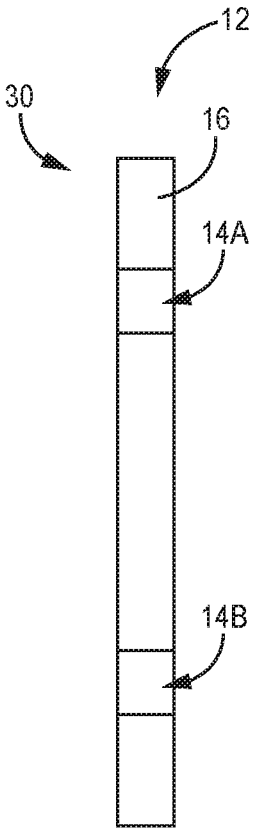
FIG. 1C is a side view of the device, according to one embodiment.

Turning to the figures, FIGS. 1A, 1B, and 1C depict the device 12 or article 12 according to one embodiment, with FIG. 1A depicting a top view of the device 12, FIG. 1B depicting the motor contact surface 28 (also referred to as a first contact surface 28), and FIG. 1C depicting the boat side contact surface 30 (also referred to as a second contact surface 30). The device 12 has a substantially rectangular body 16. The body 16 may have various contours and/or rounded corners such as those shown in this specific implementation. The body 16 may have various other contours or shapes, as would be appreciated.

The body 16 has a set of notches 14A, 14B, 18A, 18B, 20 with certain notches 14A, 14B defined in the boat side contact surface 30 and certain notches 18A, 18B, 20 defined in the motor contact surface 28. The notches 14A, 14B have shapes that match with various physical features of the predetermined boat such that the notches 14A, 14B fit around or couple with those portions of the boat, such as the mounting bracket and/or transom. Similarly, the notches 18A, 18B, 20 have shapes that match with various physical features of the predetermined motor such that the notches 18A, 18B, 20 fit around or couple with those portions of the motor (seen in FIGS. 3-6 below).

Figure 2:
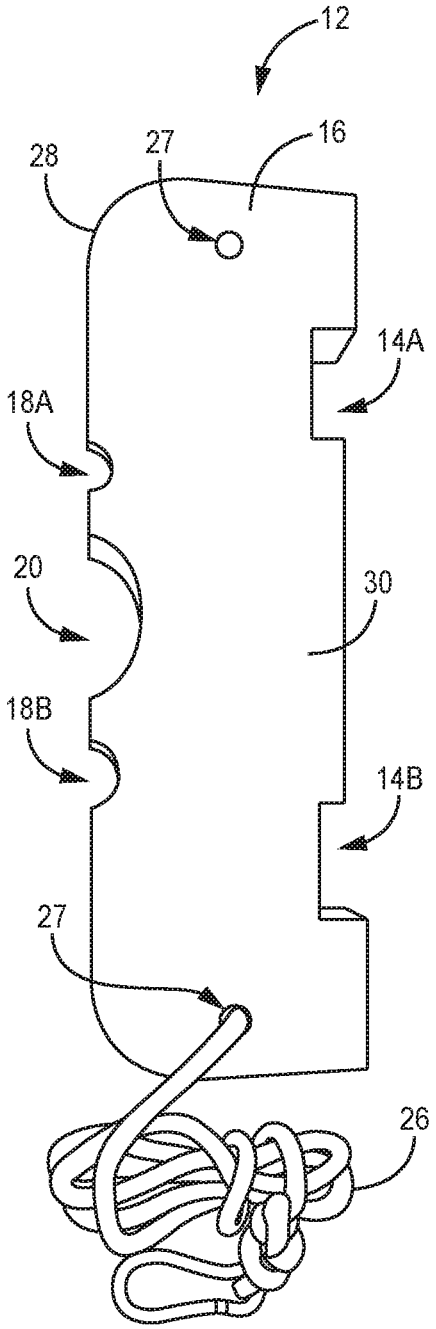
FIG. 2 is a top view of the device, according to one embodiment.
Figure 3:
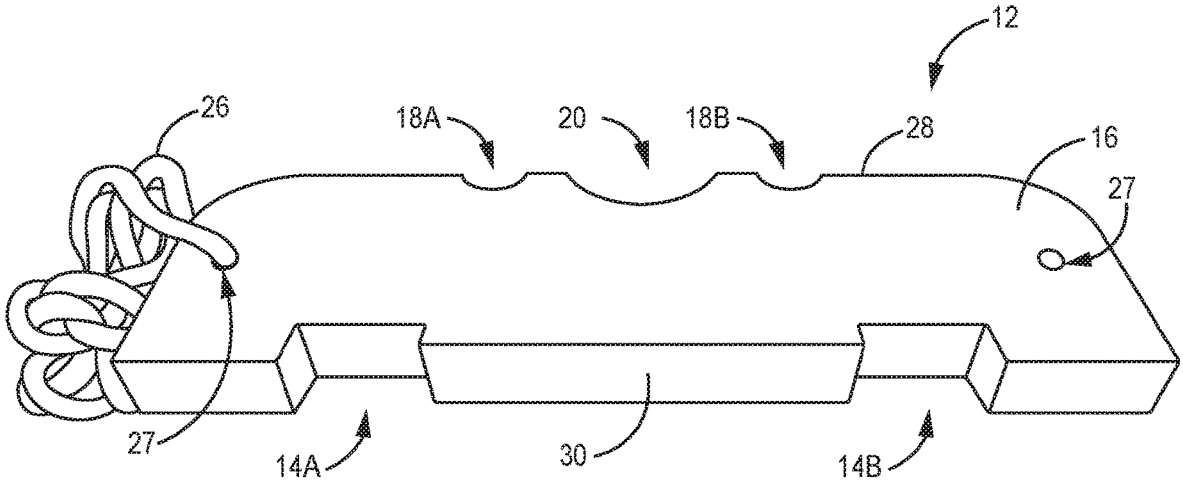
FIG. 3 is a rear perspective view of the device, according to one embodiment.

FIG. 2 depicts a top view of another embodiment of the device 12 in which the device 12 has a tether 26. Further, FIG. 3 depicts a rear perspective view of the device with the tether 26. In some implementations a tether 26 is operatively attached to the body 16 of the device 12. In various implementations, the tether 26 may be threaded through an opening 27 within the body 16. In some implementations, the device 16 may include one or more openings 27 for passage of the tether 26, such that the tether 26 can be operatively connected to either side of the device 12 as desired. It would be appreciated that the openings 27 shown in FIGS. 2 and 3 may be present in any of the disclosed embodiments, such as, but not limited to, those embodiments shown in FIGS. 1A-1C. Of course, alternative mechanisms for operatively attaching the tether 26 to the device 12 are possible and would be recognized by those of skill in the art. The tether 26 may then be attached to the boat (as shown in FIG. 4 below).

Figure 4:
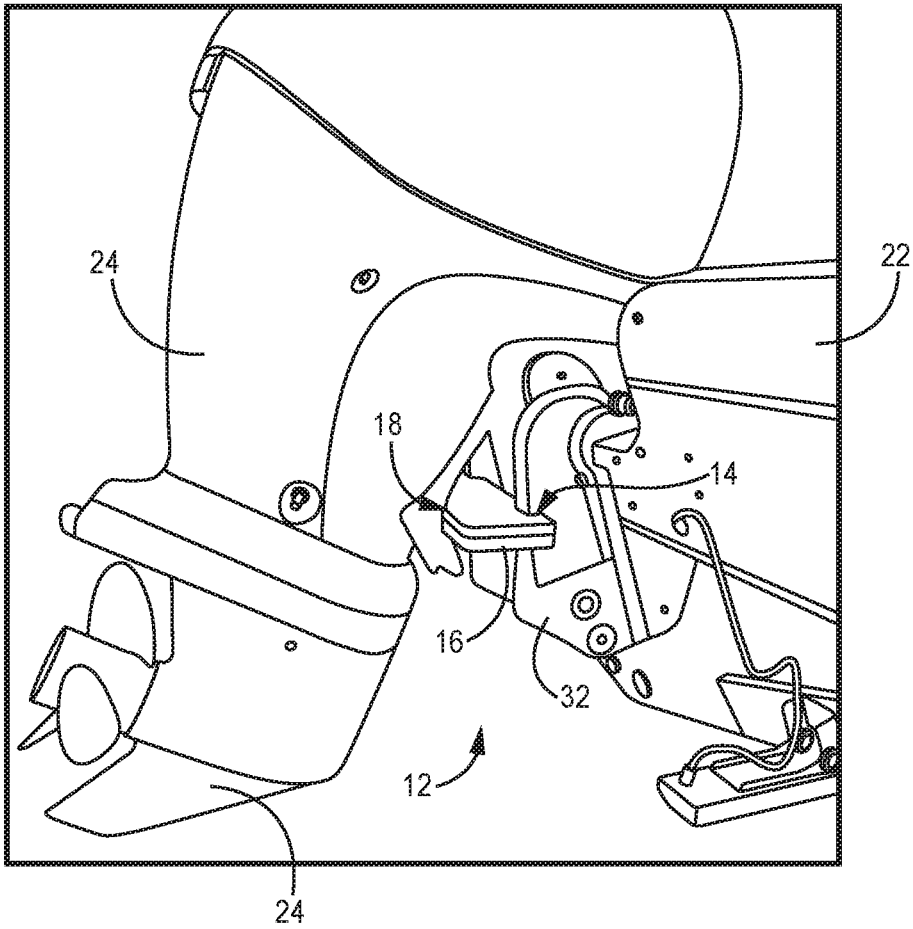
FIG. 4 is a side perspective view of the device in use, according to one embodiment.
Figure 5:
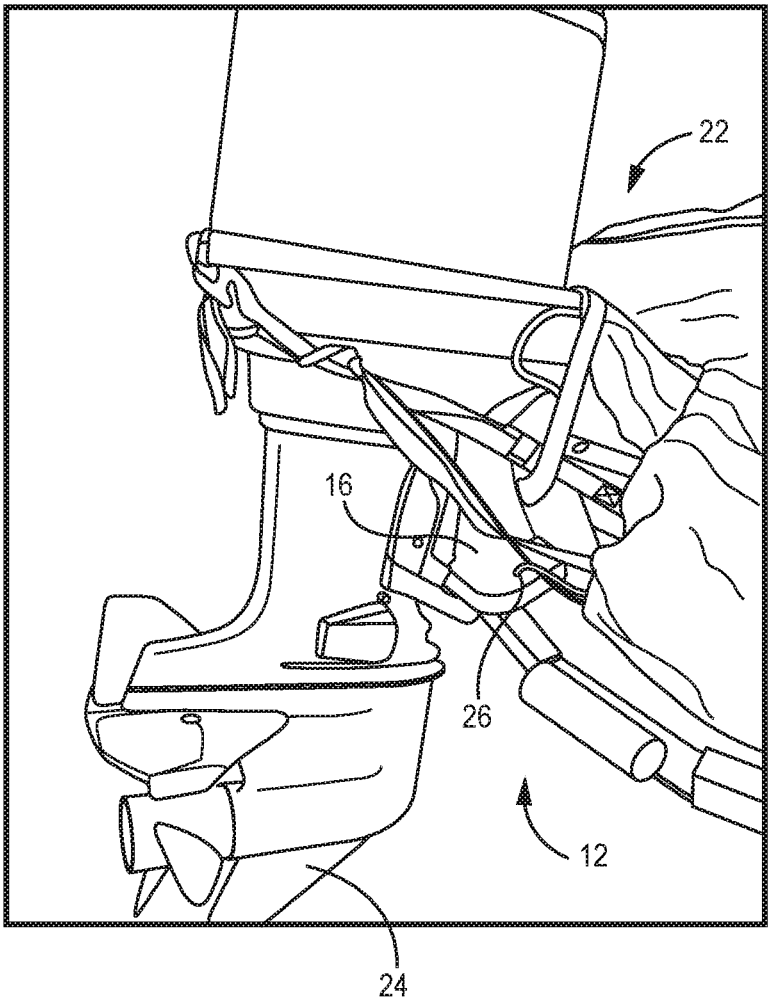
FIG. 5 is a side perspective view of the device in use, according to one embodiment.
Figure 6:
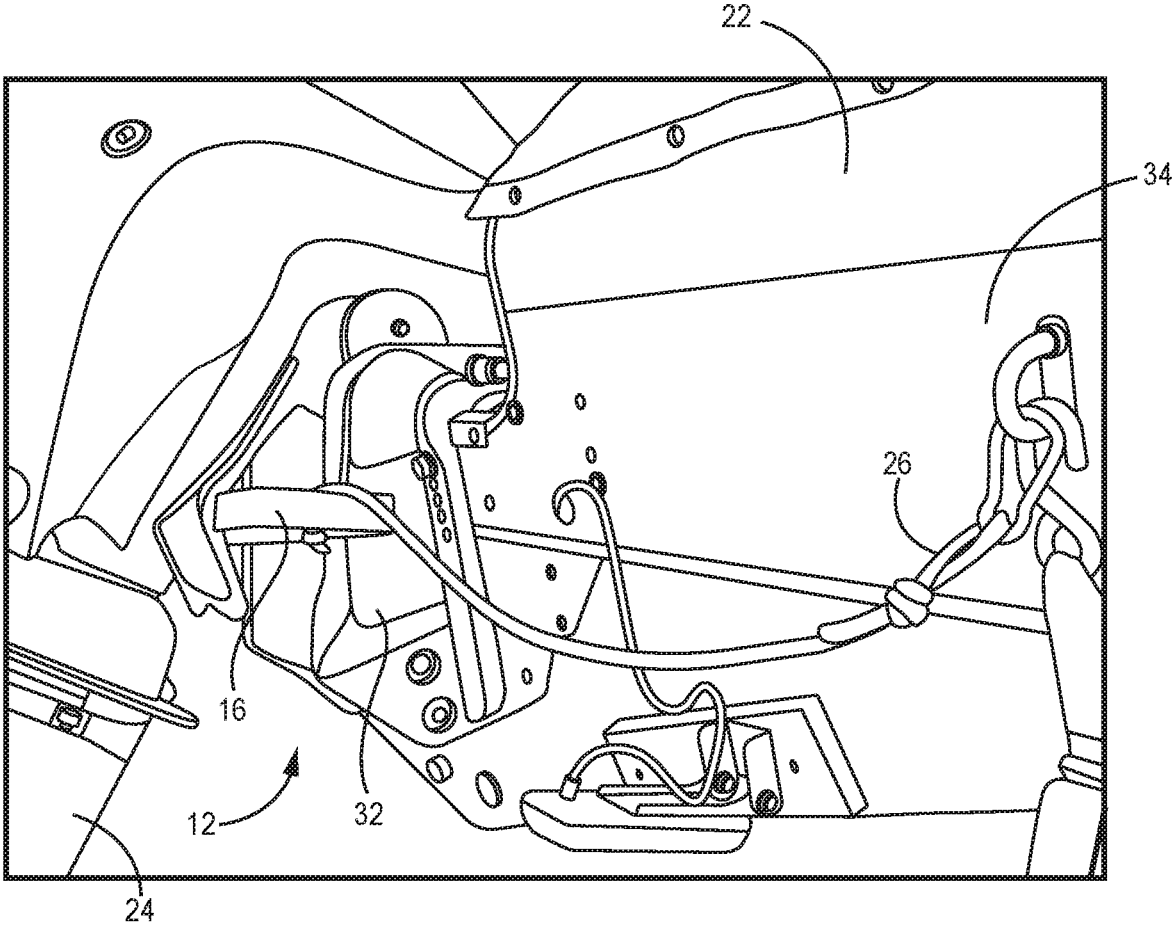
FIG. 6 is a side perspective view of the device in use, according to one embodiment.
Figure 7:
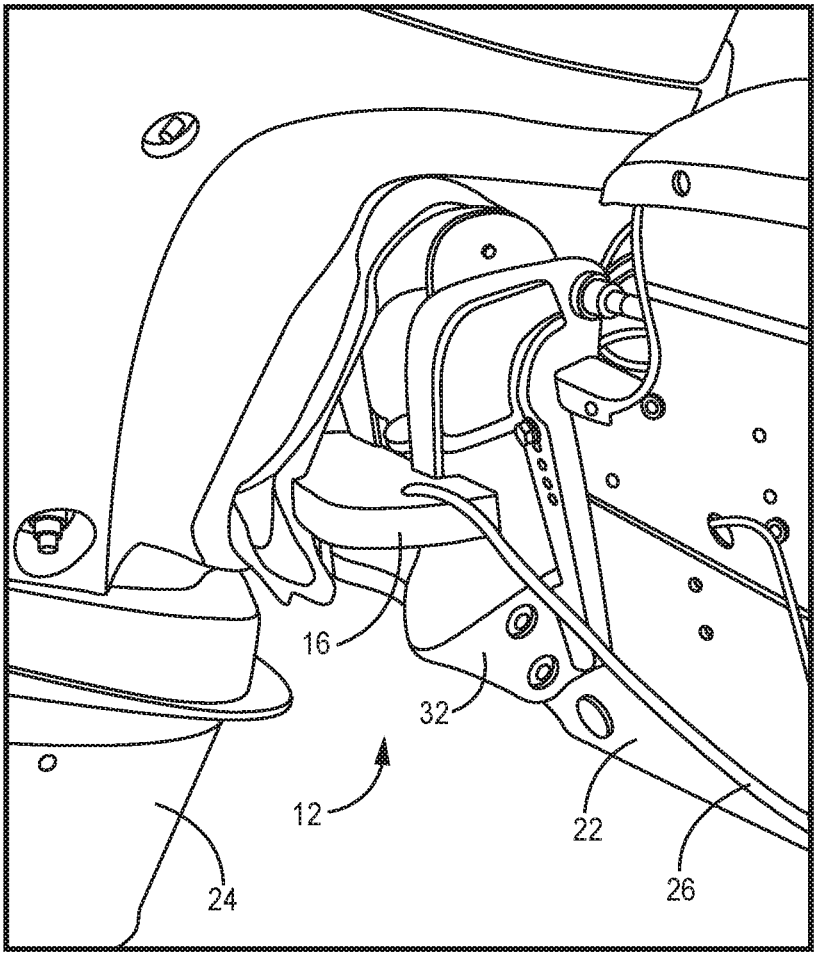
FIG. 7 is a perspective view of the device in use, according to one embodiment.
Figure 8:
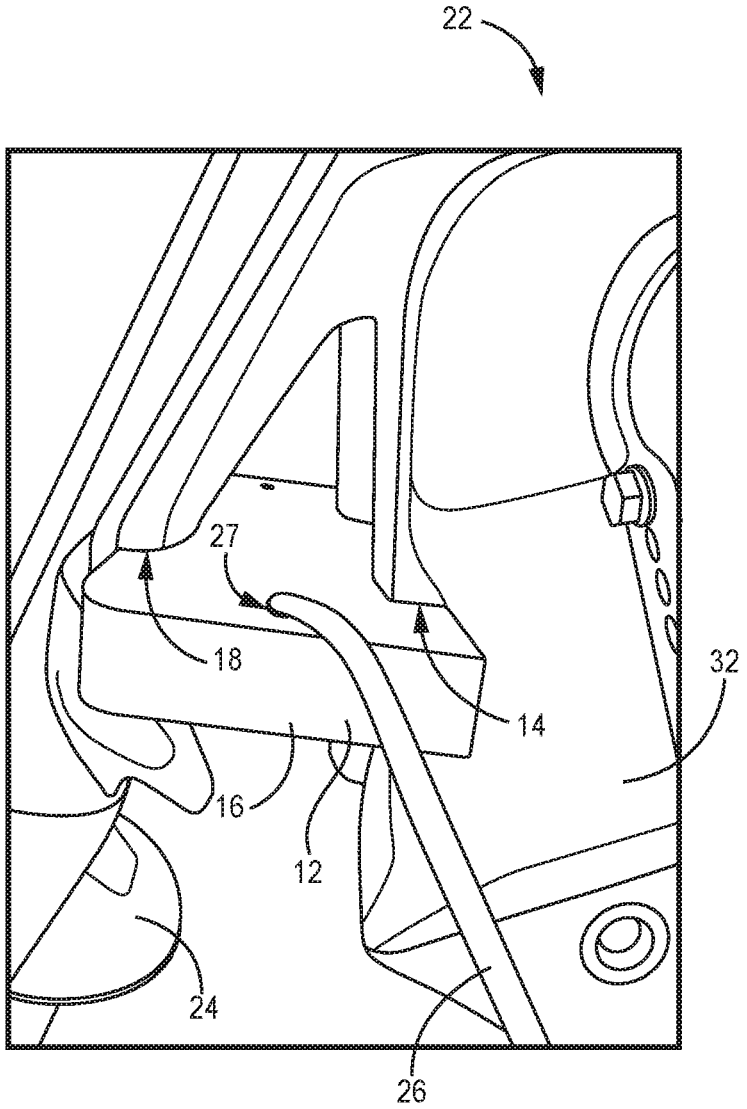
FIG. 8 is a side view of the device in use, according to one embodiment.

FIGS. 4-8 show various implementations of the device 12 in use. FIGS. 4 and 5 show the device 12 in use from the right side, FIGS. 6-8 show various views of the device 12 in use with the tether 26 attached to the boat 22 on the right side. It would be appreciated that the device 12 may include a tether 26 and be attached to the boat 22 on the left side in a similar manner as that on the right.

When the device 12 is in use, the device 12 is placed between the outboard motor 24 and the boat 22. The notches 14A, 14B, 18A, 18B, 20 securely fit around various pieces of the motor 24, boat 22, and mounting bracket 32.

The device 12 body 16 has boat side notches 14A, 14B on the boat side contact surface 30 and motor notches 18A, 18B, 20 on the opposing motor contact surface 28. In some embodiments, the boat side notches 14A, 14B are shaped to fit securely around the mounting bracket 32 of the motor that is attached to the transom of the boat 22. In other implementations, the boat side notches 14A, 14B are shaped to fit securely around various portions of the rear of the boat 22, also sometimes referred to as a transom. The boat side contact surface 30 may be in direct contact with either or both of the transom and mounting bracket 32.

In various implementations, the motor 24 will be mounted on the boat 22 by a mounting bracket 32 with two substantially parallel posts. The notches 14A and 14B may be configured to fit securely around the posts. In one specific example, the boat side notches 14A, 14B are about 1 inch in depth and 1¾ inches across. In another example, the boat side notches 14A, 14B are placed about 8½ inches apart and are 3 inches from the outer edge of the body 16. These measurements are given for illustrative purposes only and are not to be construed as limiting. The notches 14A, 14B may be of various shapes, sizes, and placements to fit the particular boat 22, motor 24 and/or mounting bracket 32.

The body 16 has motor side notches 18A, 18B, 20. In some implementations, the motor side notches 18A, 18B are shaped to fit securely around the motor side of the mounting bracket 32. In some implementations the motor side notches 18A and 18B are semicircular or may be other shapes, as would be appreciated, to create a secure fit. In various embodiments the motor side notches 18A, 18B may have a diameter of about 1 inch and protrude inward of the body 16 about ½ inch. The motor side notches 18A, 18B may be placed about 6 inches from the side of the body 16 and about 6 inches apart. These measurements are given for illustrative purposes only and are not to be construed as limiting. The notches 18A, 18B may be of various shapes, sizes, and placements to fit the particular boat 22, motor 24 and/or mounting bracket 32.

In some embodiments, the motor contact surface 30 has a center notch 20 for contact with the midsection of the motor 24. The center notch 20 may be shaped to fit securely with the midsection of the motor 24. In some embodiments, the center notch 20 will have a diameter of about 3½ inches and protrude inward of the body 16 about 1 inch. The center notch 20 may be placed about 9 inches from the side of the body 16. These measurements are given for illustrative purposes only and are not to be construed as limiting. The notch 20 may have a different shape, size, and/or placement to fit the particular boat 22, motor 24 and/or mounting bracket 32.

FIGS. 6-8 show another view of the device 12 in use with the tether 26 attached. In some embodiments, the tether 26 attaches to the boat 22 via a clip and ring configuration 34 or any other known attachment mechanism, as would be appreciated by those of skill in the art. The tether 26 is attached to the body 16 of the device 12 such that if the motor 24 were raised while the device 12 was in place the tether 26 would prevent loss of the device 12. That is, as the motor 24 is raised, the device 12 is no longer maintained in its desired position by the weight of the motor 24 and would inevitably fall. The tether 26 would retain the device 12 such that the device 12 would be hanging from the boat 22 via the tether 26. For example, use of the tether 26 may be advantageous because if the boat 22 is launched while the device 12 is still in place, the device 12 can easily be removed while a user is in the boat 22 and the boat 22 is in water. In various implementations, the device 12 can be removed by lifting the motor 24. This action releases the device 12, allowing the device 12 to be pulled into the boat 22 by a user via the tether 26.

FIGS. 7 and 8 depict other views of the device 12 in use between the motor 24 and the boat 22. As can been seen in these particular embodiments, the boat side notches 14A, 14B fit securely around the mounting bracket 32 on the boat and the motor side notches 18A, 18B, 20 fit securely around the motor 24. The device 12 is held in place by the friction and pressure between the motor 24, mounting bracket 32, and boat 22.

Figure 9:
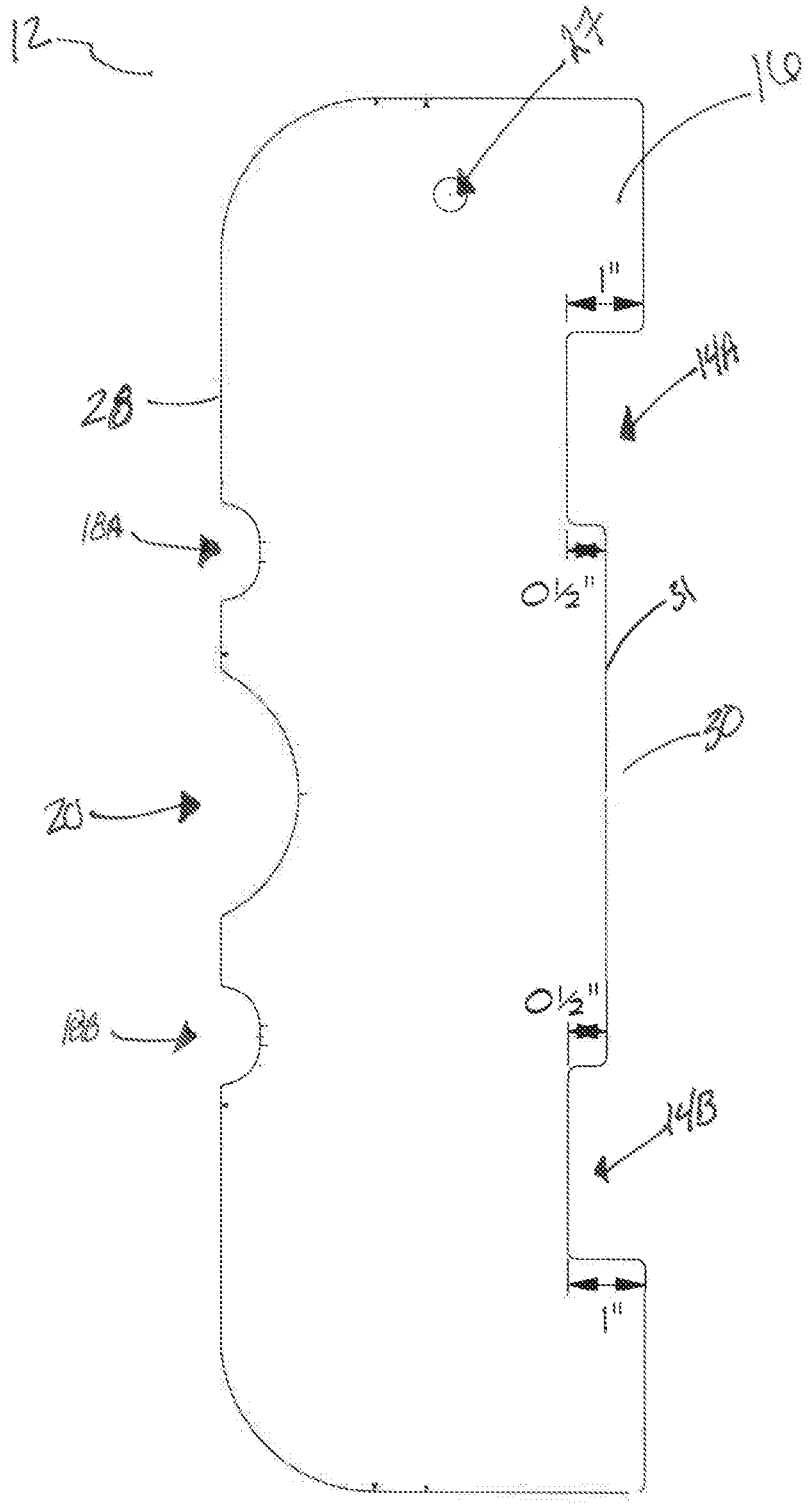
FIG. 9 is a top view of the device, according to another embodiment.

FIG. 9 depicts an alternate embodiment of the device or article 12. In these and other embodiments, boat side contact surface 30 may include a recessed portion 31 between the notches 14A, 14B. Further, in some implementations, the notches 14A, 14B are of larger dimensions. In this specific example, the boat side notches 14A, 14B are about 1 inch in depth and 2½ inches across. In another example, the boat side notches 14A, 14B are placed about 7 inches apart and are 3 inches from the outer edge of the body 16. In some implementations, the recessed portion 31 is recessed about ½ inch from the outer edge of the body 16, In these and other embodiments, the portions of the device not described herein are substantially similar to the implementations described above.

Although the disclosure has been described with references to various embodiments, persons skilled in the art will recognized that changes may be made in form and detail without departing from the spirit and scope of this disclosure.

What is claimed is:

1. An outboard motor cushion having a substantially rectangular body comprising:
(a) a first contact surface;
(b) a second contact surface;
(c) a plurality of first notches in the first contact surface;
(d) a plurality of second notches in the second contact surface; and
(e) a tether operatively engaged with the body,
wherein the plurality of first notches are sized and shaped to fit an outboard motor, and
wherein the plurality of second notches are sized and shaped to fit a mounting bracket.

2. The cushion of claim 1, wherein the cushion is comprised of EPDM rubber.

3. The cushion of claim 1, further comprising a clip attached to the tether wherein the clip is constructed and arranged to be releasably engaged with a boat.

4. The cushion of claim 3, further comprising an opening defined within the body, wherein the tether is threaded through the opening.

5. The cushion of claim 1, further comprising at least one third notch sized and shaped to fit a midsection of an outboard motor.

6. The cushion of claim 1, wherein the plurality of first notches are semicircular.

7. A device for supporting an outboard motor comprising:
(a) a body comprising:
(i) a first contact surface; and
(ii) a second contact surface;
(b) a first notch and a second notch defined within the first contract surface;
(c) a third notch defined within the second contact surface; and
(d) a tether operatively engaged with the body,
wherein the first contact surface is configured to interface with an outboard motor, and wherein the second contact surface is configured to interface with an outboard motor mounting bracket.

8. The device of claim 7, wherein the device is comprised of EPDM rubber.

9. The device of claim 7, further comprising a fourth notch defined within the first contact surface and a fifth notch defined within the second contact surface.

10. The device of claim 7, wherein the body is substantially rectangular.

11. The device of claim 7, wherein the tether is threaded through an opening within the body.

12. The device of claim 11, further comprising a clip fixedly attached to the tether, wherein the clip is configured to be releasably attached to a boat.

13. An outboard motor cushion having a substantially rectangular body comprising:

(a) a first contact surface comprising:

(i) a first notch;

(ii) a second notch; and (iii) a third notch;

(b) a second contact surface comprising:

(i) a fourth notch and (ii) a fifth notch; and (c) a tether operatively engaged with the substantially rectangular body, wherein the first notch, second notch, and third notch are sized and shaped to operatively couple various portions of an outboard motor, and wherein the fourth notch and fifth notch are sized and shaped to operatively couple various portions of a mounting bracket or transom.

14. The outboard motor cushion of claim 13, wherein the tether further comprises a clip.

15. The outboard motor cushion of claim 13, wherein the first notch and second notch are semicircular and about 1 inch in diameter.

16. The outboard motor cushion of claim 15, wherein the third notch is semicircular and about 3.5 inches in diameter.

17. The outboard motor cushion of claim 16, wherein the fourth notch and fifth notch are about 1 inch in depth and 1.75 inches wide.

* * * * *